United States Patent [19]

Hoeks et al.

[11] 4,422,553

[45] Dec. 27, 1983

[54] TABLET SPLITTING DEVICE

[76] Inventors: Harold L. Hoeks, 3295 West River Rd., N.W., Grand Rapids, Mich. 49503; Donald D. Robinson, 1950 Hall St., S.E., Grand Rapids, Mich. 49506

[21] Appl. No.: 419,441

[22] Filed: Sep. 17, 1982

[51] Int. Cl.[3] ..... B26F 3/00; B65D 85/56

[52] U.S. Cl. ..... 206/528; 206/216; 206/234; 220/212; 225/93; 225/96.5; 215/100 R; 215/228

[58] Field of Search ..... 206/528, 216, 234, 238; 220/212; 215/228, 100 R

[56] References Cited

U.S. PATENT DOCUMENTS 3,815,802 6/1974 Stevens ..... 206/528

*Primary Examiner*—William T. Dixson, Jr.

[57] ABSTRACT

A pharmaceutical tablet container whose physical configuration permits the container to function as a tool to split a tablet into half dosages.

11 Claims, 3 Drawing Figures

TABLET SPLITTING DEVICE

SUMMARY OF THE INVENTION

The invention specified herein allows the user who has need for a partial dosage of a pharmacuetical tablet to utilize the tablet container as a device to split the tablet into the desired dosage. This secondary function of the container is accomplished by incorporating a cutting edge into the physical design of the container. The container consists of two parts: a main body and a removable cap. These parts may be made using conventional molding processes and may be constructed of transparent or semi-transparent synthetic materials.

DESCRIPTION OF THE PATENT DRAWING

Figure 1:
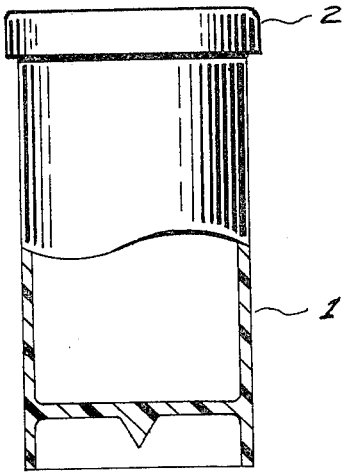

FIG. 1. illustrates a partial section view of a basic, two-piece container whose bottom is recessed to incorporate a central cutting edge thereby creating two separate cavities on either side of the cutting edge. Part 1. represents a main body of the container. Part 2. represents a removable cap.

Figure 2:
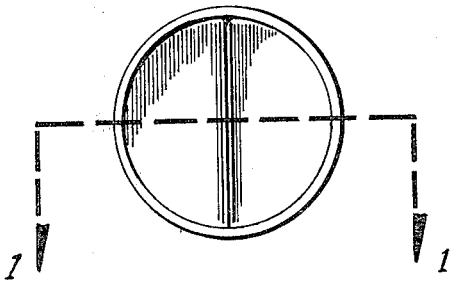

FIG. 2. illustrates a plan view of a central cutting edge on a container forming two segmented cavities.

Figure 3:
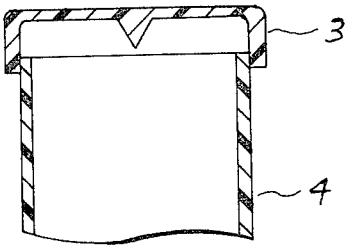

FIG. 3. illustrates a partial section view of a basic, two-piece container whose removable cap, labelled part 3., incorporates a central, recessed cutting edge thereby forming two seperate cavities on either side of the cutting edge. Part 4. represents a main body of a basic container with a conventional flat bottom.

DESCRIPTION OF THE INVENTION

The intent of the invention described herein is to assist arthritic, handicapped, elderly, and other individuals who may have some physical difficulty in performing the relatively simple task of splitting pharmaceutical tablets into desired half dosages. The various means currently employed to split a tablet into halves, such as the use of a knife, between two spoons, or other techniques, can be ineffectual and frustrating to persons whose physical dexterity is limited. The device specified herein finds its social utility by facilitating this task.

A tablet splitting device can be made available to this segment of the public, by the addition of a simple cutting edge into the physical design of containers already used to dispense pharmaceutical tablets. A tablet splitting pharmaceutical container can be created by altering the physical configuration of a conventional pharmaceutical container, or bottle, so that its shape incorporates a cutting edge and forms a cavity on each side of this cutting edge.

The cutting edge configuration may vary in size, geometry, and location on the container. After a tablet has been placed on a flat surface, the cutting edge of the container-device is centered over the tablet and human pressure is applied splitting the tablet into halves.

The cavity configuration on each side of the cutting edge may vary in size, geometry, and location on the container. The shape may semi-enclose or totally enclose the space surrounding the cutting edge and forming each cavity. After a tablet has been split using the cutting edge, the tablet halves, or portions, are physically captured and remain trapped in the void of each cavity until the container-device is lifted above the flat surface on which the tablet portions rest. The unused half or portion of the tablet may be returned to the container for storage and future use, and the container resealed to protect the tablets.

As described thus far, the novel tablet splitting device comprised of a cutting edge with adjacent cavities could be incorporated into a container in various shapes, forms, and locations on the container. More specifically, two principle arrangements of the container-device seem most practical. First, incorporation of the device into the bottom of the main body of the container. Second, incorporation of the device into the underside of the removable cap of the container.

In the first case, incorporation of the device into the bottom of the main body of the container (see FIG. 1., part 1. of the patent drawing) is accomplished as follows: The existing bottom surface of a conventional container's main body is recessed some distance upward creating a void underneath the main body and is enclosed or semi-enclosed by a circular rim whose lower edge now functions as a new bottom surface for the container when placed at rest on a flat surface. A central cutting edge is incorporated and protrudes downward from the new recessed surface thereby dividing the void into two cavities.

The user of this arrangement of a tablet splitting pharmaceutical container would remove the container cap and place a tablet on a flat surface such as a tabletop or countertop. Then by orientating the cutting edge of the main body over the tablet and applying human pressure in a downward direction, the tablet is split and the resulting portions are captured in the adjacent cavities. The container-device is lifted above the flat surface and the unused half or portion is returned to the container for storage and future use.

In the second case, incorporation of the device into the underside of the removable cap on the container (see FIG. 3., part 3. of the patent drawing) is accomplished as follows: Since a removable cap inherently possesses a void on the underside when it is placed in contact with a flat surface, only the addition of a central cutting edge is required to create a tablet splitting pharmaceutical container. This cutting edge divides the void under the cap of the container thereby forming a cavity on each side.

The user of this arrangement of a tablet splitting pharmaceutical container would remove the container cap and place a tablet on a flat surface such as a tabletop or countertop. Then by orientating the cutting edge of the container cap over the tablet and applying human pressure in a downward direction, the tablet is split and the resulting portions are captured in the adjacent cavities. The container-device is lifted above the flat surface and the unused half or portion is returned to the container for storage and future use.

A tablet splitting pharmaceutical container as described, both generically and in two specific cases, requires only slight structural alterations to a conventional pharmaceutical container in order to create a novel container-device. Therefore, a tablet splitting pharmaceutical container may not be readily identified as a consumer object for the joint purposes of splitting tablets and storing tablets. The mere incorporation of a cutting edge and cavity configuration into the physical shape of a conventional pharmaceutical container may not be self-evident to the user as a new additional function of such a commonplace object.

This unobvious nature of the invention would require some educational effort directed at the professional pharmaceutical community and re-education of the general public so that such a container-device could be effectively marketed. Once comprehended, such a tablet splitting pharmaceutical container could serve as a useful object in society, especially for those persons with unusual needs.

We claim:

1. A tablet splitting pharmaceutical container comprised of a main body of the container and a removable cap of the container used for the storage of pharmaceutical tablets, wherein the improvement comprises an incorporation of a tablet splitting device into the physical configuration of the container whose elements constitute: a physical cutting edge used to split whole tablets into portions; and, physical cavities adjacent to the cutting edge used to capture the split tablet portions with the container-device.

2. A tablet splitting pharmaceutical container wherein the improvement comprises all the limitations of the preceeding claim 1 of this application and also incorporates the device configuration specifically into the bottom of the main body of the container.

3. A tablet splitting pharmaceutical container wherein the improvement comprises all the limitations of the prceeding claim 1 of this application and also incorporates the device configuration specifically into the underside of the removable cap of the container.

4. A device for splitting tablets or the like into parts and retaining the parts, comprising a body having an end portion, a recess formed in said end portion such that the body has side walls surrounding the recess, and a cutting member mounted in the recess between the side walls, the cutting member having a cutting edge facing and adjacent the end portion, such that a tablet can be split by laying the tablet on a flat surface, placing the cuting edge against the tablet, and pressing the body down over the tablet, the cutting edge splitting the tablet and the side walls retaining the tablet parts within the recess in the body.

5. A device according to claim 4 wherein the body comprises a tubular member having at least one open end that forms the end portion of the body, the cutting member being mounted in said open end in such a position that when the open end is placed over a tablet lying on a flat surface with the cutting edge in alignment with the tablet and pressed down, the cutting edge will split the tablet and the end of the tubular member will retain the parts of the tablet within the tubular member.

6. A device according to claim 5 wherein the tubular member is formed of transparent plastic so as to permit the user easy visibility of the cutting edge placement against the tablet.

7. A device according to claim 4 wherein the body is a pill container comprising tubular side walls, an open top, an open interior for pills, and a bottom, the tubular side walls extending downwardly past the bottom to form a cavity at the lower end of the container, the cutting edge being positioned in the cavity such that a tablet is split by placing the lower end of the pill container over a tablet with the cutting edge against the tablet.

8. A device according to claim 7 wherein the pill container and cutting edge are integrally formed of moldable plastic.

9. A device according to claim 4 wherein the cutting edge is incorporated into the underside of a cap for a pill container, the cap being the body of the device and comprising a flat top and a skirt extending downwardly from the edges of underside of the top, the cutting edge being positioned on the underside of the top.

10. A device according to claim 9 wherein the cap and cutting edge are integrally formed of moldable plastic.

11. A device for cutting an object into parts and retaining the parts, comprising a body, cutting edge means mounted in the body for cutting the object into parts by moving said cutting edge means into said object, and retaining means in the body for retaining the parts within the body for easy recovery, the retaining means comprising a portion of the body enclosing the sides of the cutting edge means so as to form enclosed, part-retaining cavities on each side of the cutting edge means.

* * * * *